US009008328B2

(12) United States Patent
Urano et al.

(10) Patent No.: US 9,008,328 B2
(45) Date of Patent: Apr. 14, 2015

(54) HEADPHONE, HEADPHONE STAND AND HEADPHONE SYSTEM

(71) Applicant: TDK Corporation, Tokyo (JP)

(72) Inventors: Takashi Urano, Tokyo (JP); Mitsunari Suzuki, Tokyo (JP)

(73) Assignee: TDK Corporation, Tokyo (JP)

( * ) Notice: Subject to any disclaimer, the term of this patent is extended or adjusted under 35 U.S.C. 154(b) by 243 days.

(21) Appl. No.: 13/629,670

(22) Filed: Sep. 28, 2012

(65) Prior Publication Data

US 2013/0223640 A1 Aug. 29, 2013

Related U.S. Application Data

(60) Provisional application No. 61/540,173, filed on Sep. 28, 2011.

(51) Int. Cl.
*H04R 1/10* (2006.01)
*H04R 3/00* (2006.01)

(52) U.S. Cl.
CPC ..... *H04R 3/00* (2013.01); *H04R 1/1008* (2013.01); *H04R 1/1025* (2013.01)

(58) Field of Classification Search
CPC .... H04R 1/1025; H04R 2420/07; H02J 7/025
USPC ..... 455/575.2; 307/104; 381/74
See application file for complete search history.

(56) References Cited

U.S. PATENT DOCUMENTS

| | | | | |
|---|---|---|---|---|
| 2005/0260953 | A1* | 11/2005 | Lefler et al. | 455/100 |
| 2007/0032274 | A1* | 2/2007 | Lee et al. | 455/575.2 |
| 2008/0278264 | A1 | 11/2008 | Karalis et al. | |
| 2009/0072629 | A1 | 3/2009 | Cook et al. | |
| 2011/0080052 | A1* | 4/2011 | Sato | 307/104 |
| 2011/0141357 | A1* | 6/2011 | Price et al. | 348/552 |

FOREIGN PATENT DOCUMENTS

| | | | |
|---|---|---|---|
| JP | 2006-230032 | A | 8/2006 |
| JP | 2011-083078 | | 4/2011 |
| WO | WO-2006/022365 | A1 | 3/2006 |

* cited by examiner

*Primary Examiner* — Alexander Jamal
(74) *Attorney, Agent, or Firm* — McDermott Will & Emery LLP

(57) ABSTRACT

A wireless headphone system 102 includes a headphone 144 and a headphone stand 104. The headphone 144 has two ear cups 150*a* and 150*b*. The ear cup 150*a* incorporates a receiving coil L3 and a capacitor C3. The ear cup 150*b* incorporates a charge controller 138 and a secondary battery 112. The headphone stand 104 incorporates a feeding coil L2. When the headphone 144 is set in the headphone stand 104, AC power is supplied from the feeding coil L2 to the receiving coil L3, and the secondary battery 112 of the headphone 144 is charged with the AC power.

5 Claims, 8 Drawing Sheets

HEADPHONE, HEADPHONE STAND AND HEADPHONE SYSTEM

BACKGROUND OF THE INVENTION

1. Field of the Invention

The present invention relates to wireless power feeding and, more particularly, to a method of applying the wireless power feeding to a headphone system.

2. Description of Related Art

A wireless power feeding technique of feeding power without a power cord is now attracting attention. The current wireless power feeding technique is roughly divided into three: (A) type utilizing electromagnetic induction (for short range); (B) type utilizing radio wave (for long range); and (C) type utilizing resonance phenomenon of magnetic field (for intermediate range).

The type (A) utilizing electromagnetic induction has generally been employed in familiar home appliances such as an electric shaver; however, it can be effective only in a short range. The type (B) utilizing radio wave is available in a long range; however, it has small electric power. The type (C) utilizing resonance phenomenon is a comparatively new technique and is of particular interest because of its high power transmission efficiency even in an intermediate range of about several meters. For example, a plan is being studied in which a receiving coil is buried in a lower portion of an EV (Electric Vehicle) so as to feed power from a feeding coil in the ground in a non-contact manner. Hereinafter, the type (C) is referred to as "magnetic field resonance type".

The magnetic field resonance type is based on a theory published by Massachusetts Institute of Technology in 2006 (refer to U.S. Patent Application Publication No. 2008/0278264). In U.S. Patent Application Publication No. 2008/0278264, four coils are prepared. The four coils are referred to as "exciting coil", "feeding coil", "receiving coil", and "loading coil" in the order starting from the feeding side. The exciting coil and feeding coil closely face each other for electromagnetic coupling. Similarly, the receiving coil and loading coil closely face each other for electromagnetic coupling. The distance (intermediate distance) between the feeding coil and receiving coil is larger than the distance between the exciting coil and feeding coil and distance between the receiving coil and loading coil. This system aims to feed power from the feeding coil to receiving coil.

When AC power is fed to the exciting coil, current also flows in the feeding coil according to the principle of electromagnetic induction. When the feeding coil generates a magnetic field to cause the feeding coil and receiving coil to magnetically resonate, high current flows in the receiving coil. At this time, current also flows in the loading coil according to the principle of electromagnetic induction, and power is taken from a load connected in series to the loading coil. By utilizing the magnetic field resonance phenomenon, high power transmission efficiency can be achieved even if the feeding coil and receiving coil are largely spaced from each other (refer to U.S. Patent Application Publication No. 2009/0072629).

Jpn. Pat. Appln. Laid-Open Publication No. 2011-83078 discloses a method of applying such magnetic-field resonance type wireless feeding to a headphone system. Referring to FIG. 4 of Jpn. Pat. Appln. Laid-Open Publication No. 2011-83078, AC power is fed by wireless from units 101 and 102 placed below a table and received by a unit 103 placed on the table. A headphone 182 placed on the unit 103 receives the AC power at a coil 171 incorporated therein, converts the received AC power into DC power, and charges a charging circuit incorporated therein with the DC power.

However, in the configuration disclosed in Jpn. Pat. Appln. Laid-Open Publication No. 2011-83078, the sizes of the units 101, 102, and 103 tend to increase, and it is difficult to make coil surfaces of a feeding coil and a receiving coil face each other. If the feeding coil and receiving coil do not face each other in a proper position, power transmission efficiency may significantly be reduced. Particularly, in the configuration disclosed in Jpn. Pat. Appln. Laid-Open Publication No. 2011-83078, it is virtually difficult to make a coil (loading coil) incorporated in a headphone and a coil (receiving coil) incorporated in the unit 103 face each other properly.

Further, when a magnetic flux generated from a coil during wireless power feeding penetrates the charging circuit (secondary battery), eddy current occurs to cause the secondary battery to generate heat. Jpn. Pat. Appln. Laid-Open Publication No. 2011-83078 does not even recognize this as a problem.

SUMMARY

The present invention has been made in view of the above problem, and a main object thereof is to perform efficient and safe wireless power feeding in a headphone system to which the wireless power feeding has been applied.

A headphone according to the present invention includes first and second ear cups. The first ear cup includes a receiving coil receiving AC power supplied by wireless from an external feeding coil and a capacitor connected to the receiving coil to form therewith a resonance circuit. The second ear cup includes a secondary battery charged with the AC power received by the receiving coil.

A headphone stand according to the present invention includes a hanging portion for setting a headphone, a feeding coil, and a power transmission control circuit supplying AC power to the feeding coil to make the feeding coil supply the AC power by wireless to a receiving coil incorporated in the headphone. The feeding coil faces the receiving coil in a state where the headphone is set in the hanging portion.

Another headphone stand according to the present invention includes a hanging portion for setting a headphone, first and second feeding coils, and a power transmission control circuit supplying AC power to the first and second feeding coils to make the first and second feeding coils supply the AC power by wireless to a receiving coil incorporated in the headphone. At least one of the first and second feeding coils faces the receiving coil in a state where the headphone is set in the hanging portion.

A headphone system according to the present invention includes a headphone having first and second ear cups, and a headphone stand in which the headphone is set. The first ear cup includes a receiving coil receiving AC power supplied by wireless from a feeding coil of the headphone stand and a capacitor connected to the receiving coil to form therewith a resonance circuit. The second ear cup includes a secondary battery charged with the AC power received by the receiving coil. The headphone stand includes a hanging portion for setting the headphone, a feeding coil, and a power transmission control circuit supplying AC power to the feeding coil to make the feeding coil supply the AC power by wireless to the receiving coil. The feeding coil faces the receiving coil in a state where the headphone is set in the hanging portion.

According to the present invention, a headphone system capable of performing wireless power feeding efficiently and safely can be provided.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be described with reference to the accompanying drawings.

[First Embodiment]

Figure 1:
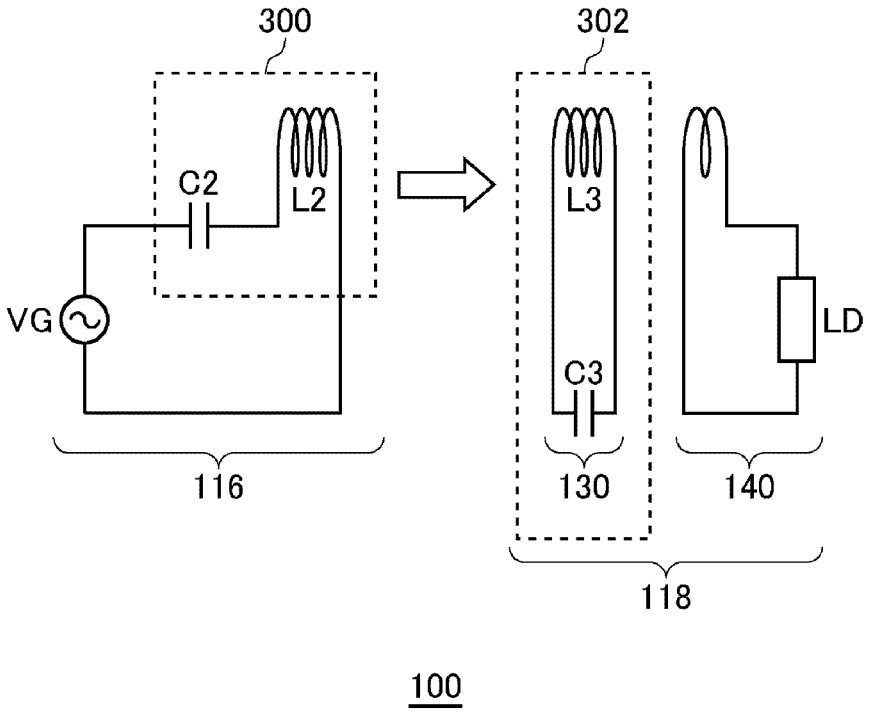
FIG. 1 is a view illustrating an operation principle of a wireless power transmission system.

FIG. 1 is a view illustrating an operation principle of a wireless power transmission system 100. The wireless power transmission system 100 includes a wireless power feeder 116 and a wireless power receiver 118. The wireless power feeder 116 includes a power feeding LC resonance circuit 300. The wireless power receiver 118 includes a receiving coil circuit 130 and a load circuit 140. The receiving coil circuit 130 constitutes a power receiving LC resonance circuit 302.

The power feeding LC resonance circuit 300 includes a capacitor C2 and a feeding coil L2. The power receiving LC resonance circuit 302 includes a capacitor C3 and a receiving coil L3. The values of the capacitor C2, power feeding coil L2, capacitor C3, and power receiving coil L3 are set such that the resonance frequencies of the power feeding LC resonance circuit 300 and power receiving LC resonance circuit 302 coincide with each other in a state where the power feeding coil L2 and power receiving coil L3 are disposed away from each other far enough to ignore the magnetic field coupling therebetween. This common resonance frequency is assumed to be fr0.

In a state where the power feeding coil L2 and power receiving coil L3 are brought close to each other in such a degree that they can be magnetic-field-coupled to each other, a new resonance circuit is formed by the power feeding LC resonance circuit 300, power receiving LC resonance circuit 302, and mutual inductance generated between them. The new resonance circuit has two resonance frequencies fr1 and fr2 (fr1<fr0<fr2) due to the influence of the mutual inductance. When the wireless power feeder 116 supplies AC power from a power feeding source VG to the power feeding LC resonance circuit 300 at the resonance frequency fr1, the power feeding LC resonance circuit 300 constituting a part of the new resonance circuit resonates at a resonance point 1 (resonance frequency fr1). When the power feeding LC resonance circuit 300 resonates, the power feeding coil L2 generates an AC magnetic field of the resonance frequency fr1. The power receiving LC resonance circuit 302 constituting a part of the new resonance circuit also resonates by receiving the AC magnetic field. When the power feeding LC resonance circuit 300 and power receiving LC resonance circuit 302 resonate at the same resonance frequency fr1, wireless power feeding from the power feeding coil L2 to power receiving coil L3 is performed with the maximum power transmission efficiency. Received power is taken from a load LD of the wireless power receiver 118 as output power. Note that the new resonance circuit can resonate not only at the resonance point 1 (resonance frequency fr1) but also at a resonance point 2 (resonance frequency fr2).

[First Embodiment]

Figure 2:
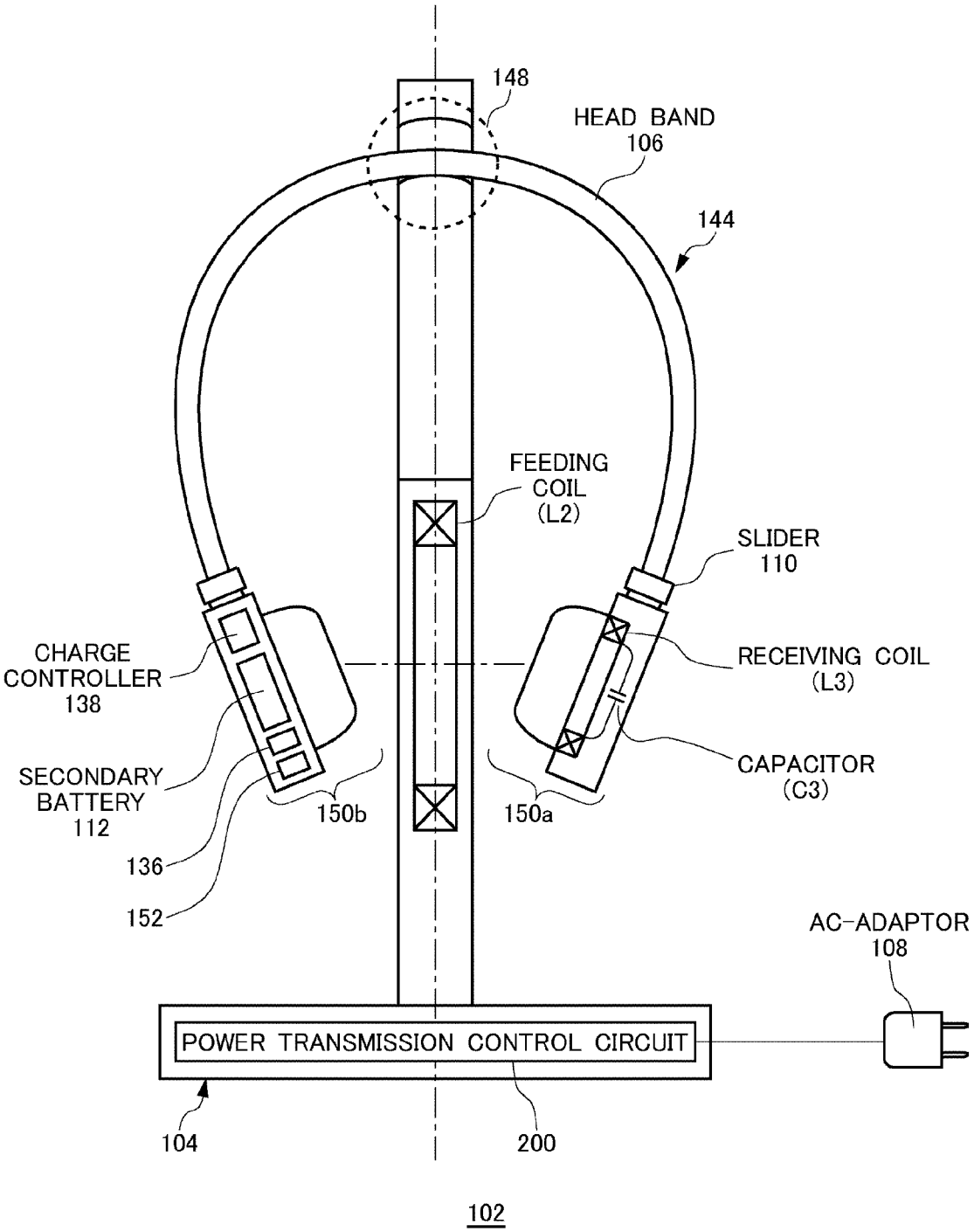
FIG. 2 is a front view of an outer appearance of a wireless headphone system according to a first embodiment.

FIG. 2 is a front view of an outer appearance of a wireless headphone system 102 according to a first embodiment. The wireless headphone system 102 is one of applications of the wireless power transmission system 100 described with FIG. 1. The wireless headphone system 102 includes a headphone stand 104 and a headphone 144. The headphone stand 104 corresponds to the wireless power feeder 116, and the headphone 144 corresponds to the wireless power receiver 118. The headphone 144 includes two ear cups 150*a*, 150*b* and a head band 106. The head band 106 can be expanded/contracted by a slider 110. By hanging the headphone 144 from a hanging portion 148 of the headphone stand 104 at the head band 106, it is possible to stably set the headphone 144 in the headphone stand 104. The hanging portion 148 has a curved shape, which will be described later using FIG. 5. Upon setting of the headphone 144 in the headphone stand 104, power is fed by wireless from the headphone stand 104 to the headphone 144.

The ear cup 150*a* (first ear cup) incorporates the receiving coil L3 and capacitor C3 (receiving coil circuit 130). The receiving coil L3 and capacitor C3 constitute a resonance circuit which is set to have a resonance frequency of fr1. The ear cup 150*b* (second ear cup) incorporates a secondary battery 112, a charge controller 138, an audio receiving unit 136, and an audio reproducing unit 152. The audio receiving unit 136 receives an audio signal by wireless, and the audio reproducing unit 152 reproduces the audio. Power received by the receiving coil L3 is fed to the secondary battery through a wiring in the head band 106 to charge the secondary battery 112. The ear cup 150*a* may incorporate the loading coil L4; however, in the present embodiment, power is supplied from the receiving coil L3 to a load LD (secondary battery 112) directly, not through the loading coil L4. The charge controller 138 converts AC current into DC current using a DC circuit (rectifying/smoothing circuit) incorporated therein to charge the secondary battery 112. The ear cup 150*a* and ear cup 150*b* incorporate the receiving coil L3, etc., and the secondary battery 112, etc., respectively to keep left and right weight balance.

The headphone stand 104 incorporates the feeding coil L2 at a position thereof facing the receiving coil L3. An AC adapter 108 converts AC power into DC power, and the obtained DC power is supplied to a power transmission control circuit 200. The power transmission control circuit 200, which is a kind of a switching power supply, produces AC power of a resonance frequency fr1 from the DC power and supplies the AC power to the feeding coil L2. The feeding coil L2 and receiving coil L3 resonate with each other at the resonance frequency fr1 and, thereby, magnetic field resonance type wireless power feeding is executed to feed power by wireless from the feeding coil L2 to the receiving coil L3.

At this time, a large magnetic field is generated around the feeding coil L2 and receiving coil L3. When the secondary battery 112 is placed in the strong magnetic field, eddy current occurs to cause the secondary battery to generate heat . In the present embodiment, the secondary battery 112 is incorporated in the ear cup 150*b* which is an ear cup different from the ear cup 150*a* in which the receiving coil L3 is incorporated, so that the secondary battery 112 can be positioned away from the strong magnetic field region caused by the wireless power feeding. Experiments made by the present inventors have revealed that in a case where AC power of about 2 (W) is supplied, a surface temperature of the secondary battery 112 can be reduced by about 3° C. when the second battery 112 is incorporated in the ear cup 150*b* as compared to when the second battery 112 is incorporated in the ear cup 150*a*.

Figure 3:
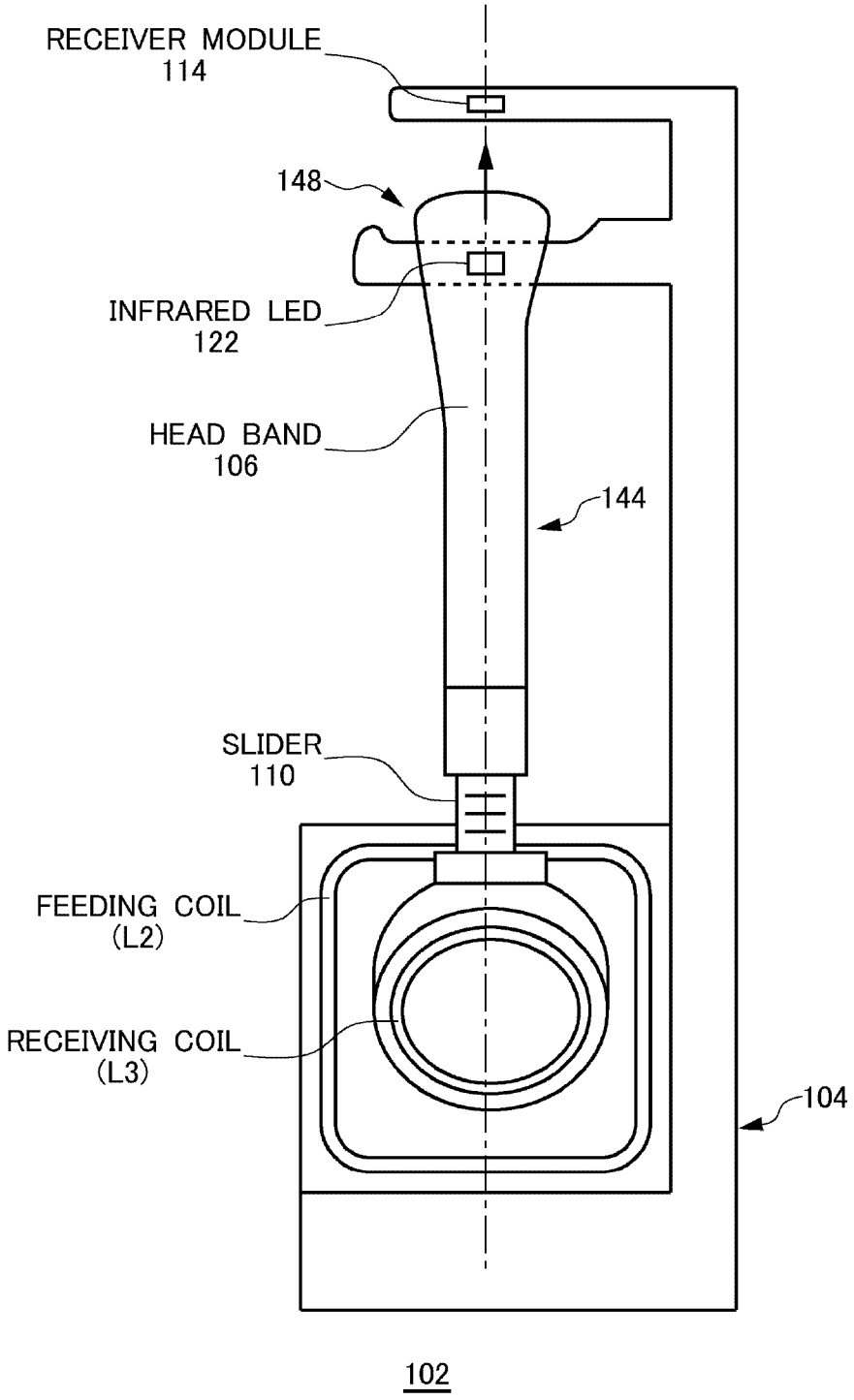
FIG. 3 is a side view of the outer appearance of the wireless headphone system according to the first embodiment.

FIG. 3 is a side view of the outer appearance of the wireless headphone system 102 according to the first embodiment. As illustrated in FIG. 3, positions of the feeding coil L2 and receiving coil L3 are set so as to make them face to each other. The hanging portion 148 incorporates a receiving module 114 (receiver). The head band 106 incorporates an infrared ray LED 122 (transmitter). The infrared ray LED 122 periodically transmits an infrared ray signal. When the receiving module 114 receives the infrared ray signal, the power transmission control circuit 200 supplies AC power to the feeding coil L2. That is, when the headphone 144 is set in the headphone stand 104, wireless power feeding from the headphone stand 104 to the head phone 144 is automatically started. When the headphone 144 is removed from the headphone stand 104, the power feeding is automatically stopped.

Figure 4:
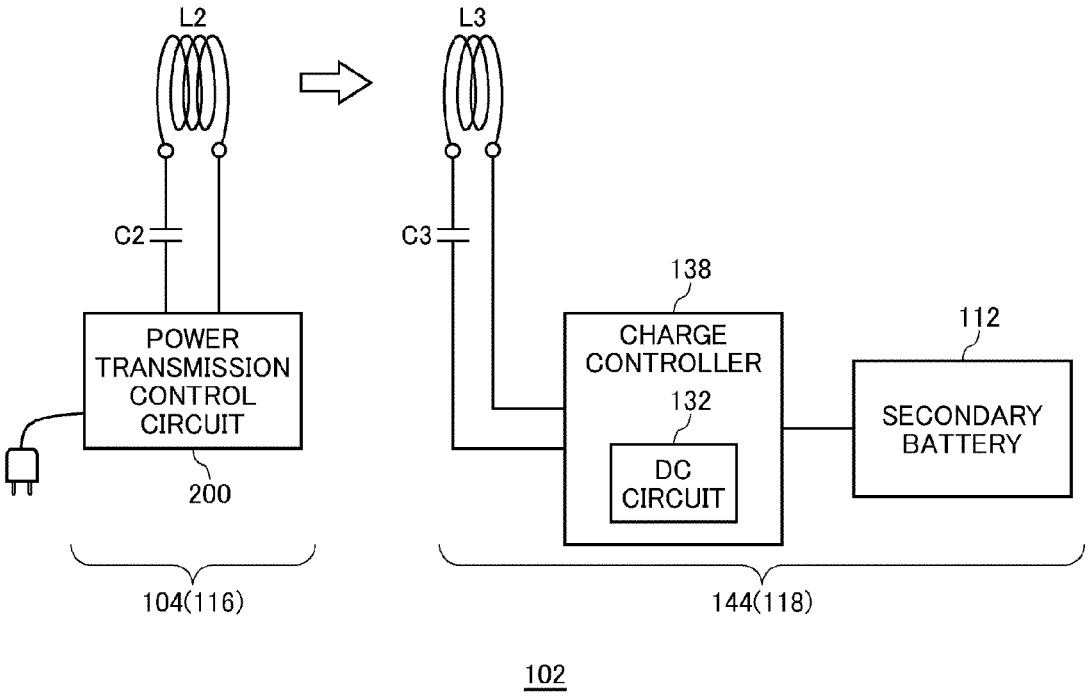
FIG. 4 is a system configuration view of the wireless headphone system according to the first embodiment.

FIG. 4 is a system configuration view of the wireless headphone system 102 according to the first embodiment. The headphone stand 104 (wireless power feeder 116) includes the feeding coil L2, capacitor C2, and power transmission control circuit 200. When the power transmission control circuit 200 supplies AC power of the resonance frequency fr1 to the feeding coil L2, the feeding coil L2 and capacitor C2 are in a resonance state, generating an AC magnetic field of the resonance frequency fr1.

The headphone 144 (wireless power receiver 118) includes the receiving coil L3, capacitor C3, charge controller 138, and secondary battery 112. The charge controller 138 includes a DC circuit 132. Although the charge controller 138 is directly connected to the receiving coil L3 in the present embodiment, the receiving coil circuit 130 and load circuit 140 may separately be provided as shown in FIG. 1.

The DC circuit 132 incorporated in the charge controller 138 converts received power into DC power and charges the secondary battery 112 with the DC power. The charge controller 138 monitors a charging state of the secondary battery 112 and stops charging the battery when the secondary battery 112 is in a full charged state. Specifically, at this time, the charge controller 138 stops transmission of the infrared ray signal from the infrared ray LED 122. The headphone stand 104 stops power supply when the receiving module 114 stops receiving the infrared ray signal.

Figure 5:
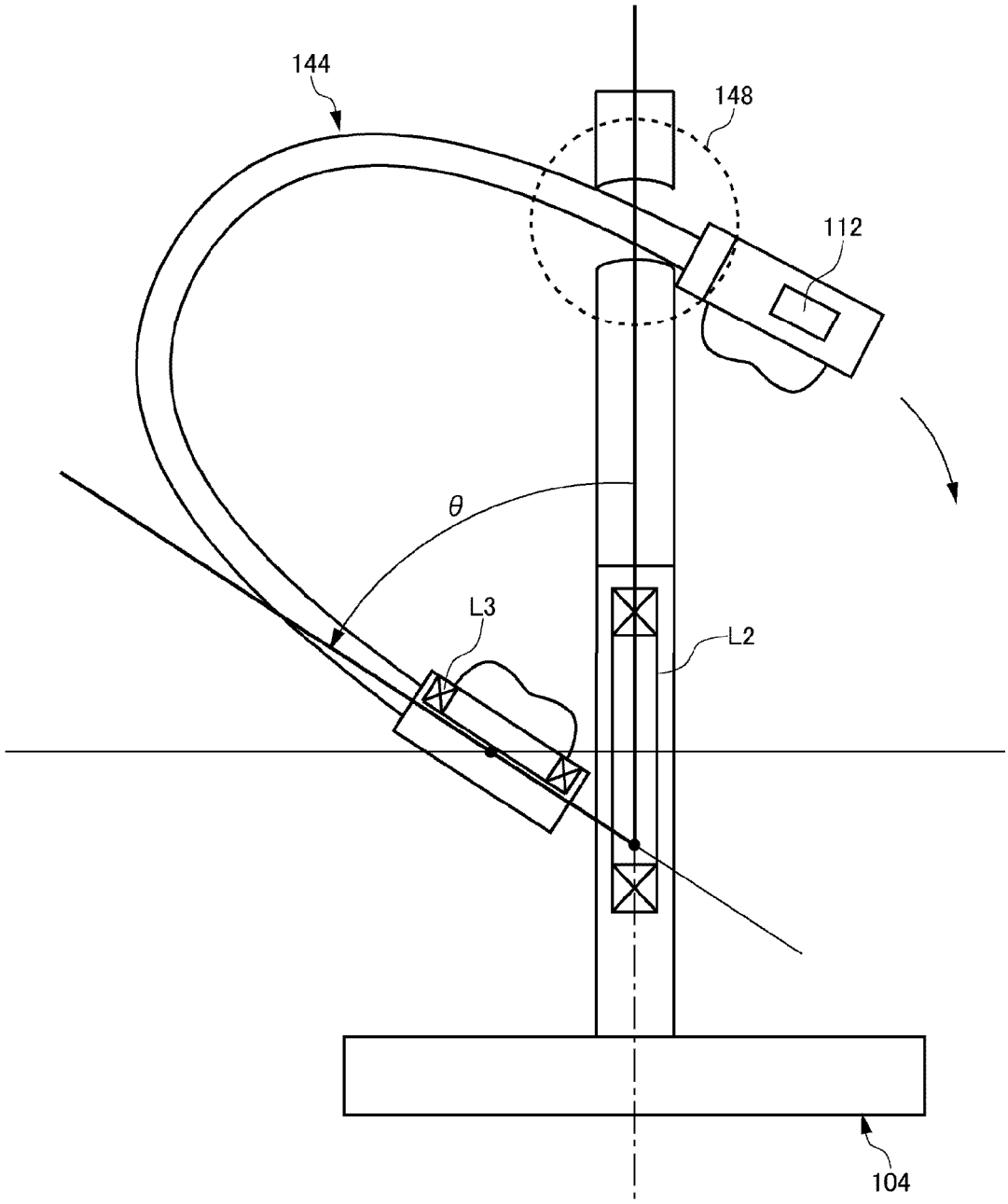
FIG. 5 is an outer appearance view illustrating a state where a headphone is set in a headphone stand in an inclined manner.

FIG. 5 is an outer appearance view illustrating a state where the headphone 144 is set in the headphone stand 104 in an inclined manner. It is assumed that an angle between coil surfaces of the feeding coil L2 and receiving coil L3 is θ. The angle θ is desirably zero; however, a user does not always set properly the headphone 144 in the headphone stand 104. When the angle θ is increased, in other words, when directions of the coil surfaces of the feeding coil L2 and receiving coil L3 do not coincide with each other, power transmission efficiency may decrease. The decrease in the power transmission efficiency may cause overcurrent in the power transmission control circuit 200. In order to avoid this, in the present embodiment, the hanging portion 148 has a curved opening portion so as to prevent the headphone 144 from being set in an excessively inclined manner relative to the headphone stand 104. Even if the headphone 144 has been set in an inclined manner, the headphone 144 is automatically slid to a proper position due to the curved hanging portion 148.

Figure 6:
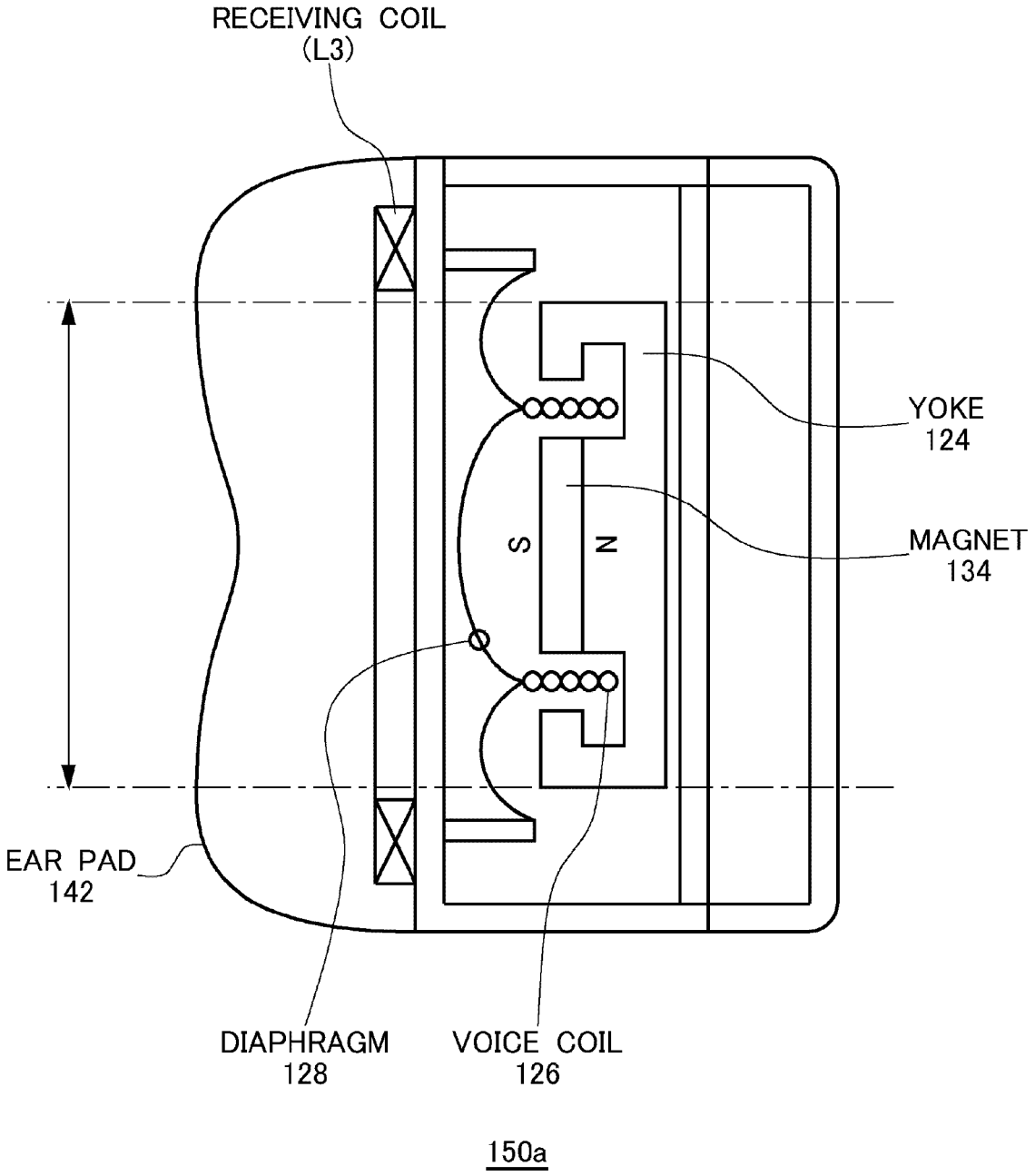
FIG. 6 is a cross-sectional view of an ear cup.

FIG. 6 is a cross-sectional view of the ear cup 150*a*. A part of the ear cup 150 that comes into contact with the ear is referred to, particularly, as "ear pad 142". The ear cup 150*a* includes a magnet 134 and a yoke 124 bonded to the magnet 134. The yoke is a member used for increasing intensity of a magnetic field of the magnet 134 and is generally formed of pure iron. A voice coil 126 is wounded around the magnet 134, and the yoke 124 is covered by a diaphragm 128. The voice coil 126 vibrates the diaphragm 128 to generate audio.

The receiving coil L3 is positioned closer to the ear pad 142 side (ear side) than the yoke 124. With this configuration, a magnetic flux passing from the feeding coil L2 to the receiving coil L3 is made to effectively converge by the yoke 124. That is, it is possible to enhance the power transmission efficiency by intensifying a magnetic field passing through the receiving coil L3 using the yoke 124 which is an essential component of the headphone 144.

[Second Embodiment]

Figure 7:
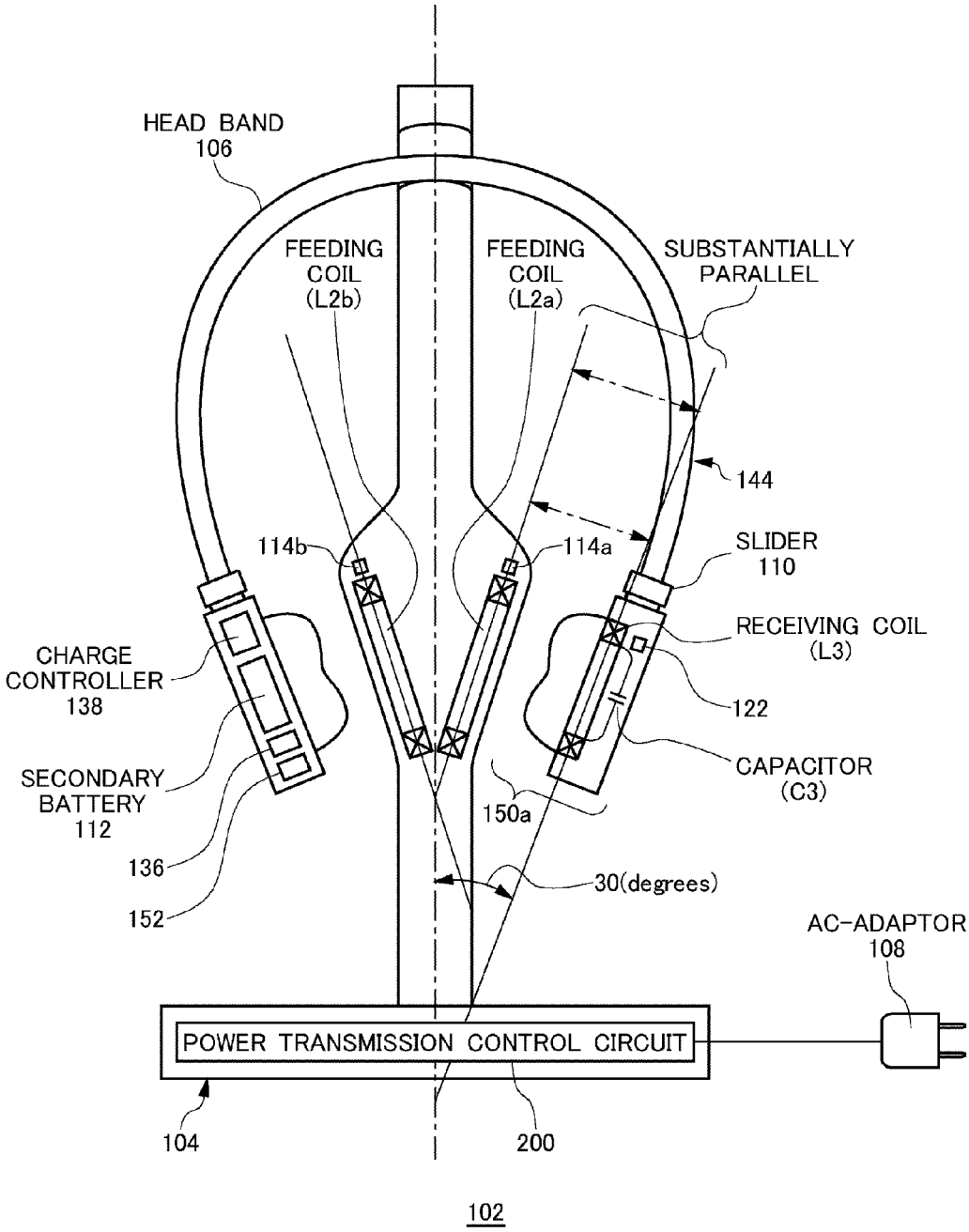
FIG. 7 is a front view of an outer appearance of the wireless headphone system according to a second embodiment.

FIG. 7 is a front view of an outer appearance of the wireless headphone system 102 according to a second embodiment. The headphone stand 104 according to the second embodiment incorporates two feeding coils L2*a* and L2*b*. The feeding coil L2*a* is inclined by 30° with respect to a vertical line, and the feeding coil L2*b* is inclined by 30° with respect to the vertical line in an opposite direction to the feeding coil L2*a*. This configuration is because, when the headphone 144 is set, the ear cups 150*a* and 150*b* are each inclined by 30° with respect to the vertical line. It follows that the feeding coils L2*a* and L2*b* are arranged in a V-shape having an inclination of 60°. With the V-shape arrangement of the feeding coils L2, the coil surfaces of the feeding coil L2 and the receiving coil L3 become substantially parallel to each other, thereby further enhancing the power transmission efficiency. According to experiments made by the present inventors, the power transmission efficiency was increased by about 10% as compared to that in the first embodiment.

A receiving module 114*a* (first receiver) is arranged near the feeding coil L2*a* (first feeding coil), and a receiving module 114*b* (second receiver) is arranged near the feeding coil L2*b* (second feeding coil). The headphone 144 incorporates the infrared ray LED 122 not in the head band 106, but in the ear cup 150*a* incorporating the receiving coil L3.

The power transmission control circuit 200 can selectively supply AC power to the two feeding coils L2*a* and L2*b*. In FIG. 7, the infrared ray signal transmitted from the infrared ray LED 122 is received by the receiving module 114*a*. Upon reception of the infrared ray signal by the receiving module 114*a*, the power transmission control circuit 200 supplies AC power to the feeding coil L2*a*. On the other hand, the receiving module 114*b* cannot receive the infrared ray signal, so that the AC power is not supplied to the feeding coil L2*b*. When the ear cup 150*a* is positioned not on the feeding coil L2*a* side, but on the feeding coil L2*b* side, the AC power is supplied to the feeding coil L2*b* and not supplied to the feeding coil L2*a*. As described above, when one of the receiving modules 114*a* and 114*b* has received the infrared ray signal from the infrared ray LED 122, wireless power feeding is conducted from the feeding coil L2 on a side that faces the ear cup 150*a*. That is, unnecessary power supply to the ear cup 150*b* (secondary battery 112) is not conducted. Thus, adequate power feeding can be performed irrespective of the installation state of the headphone 144.

Figure 8:
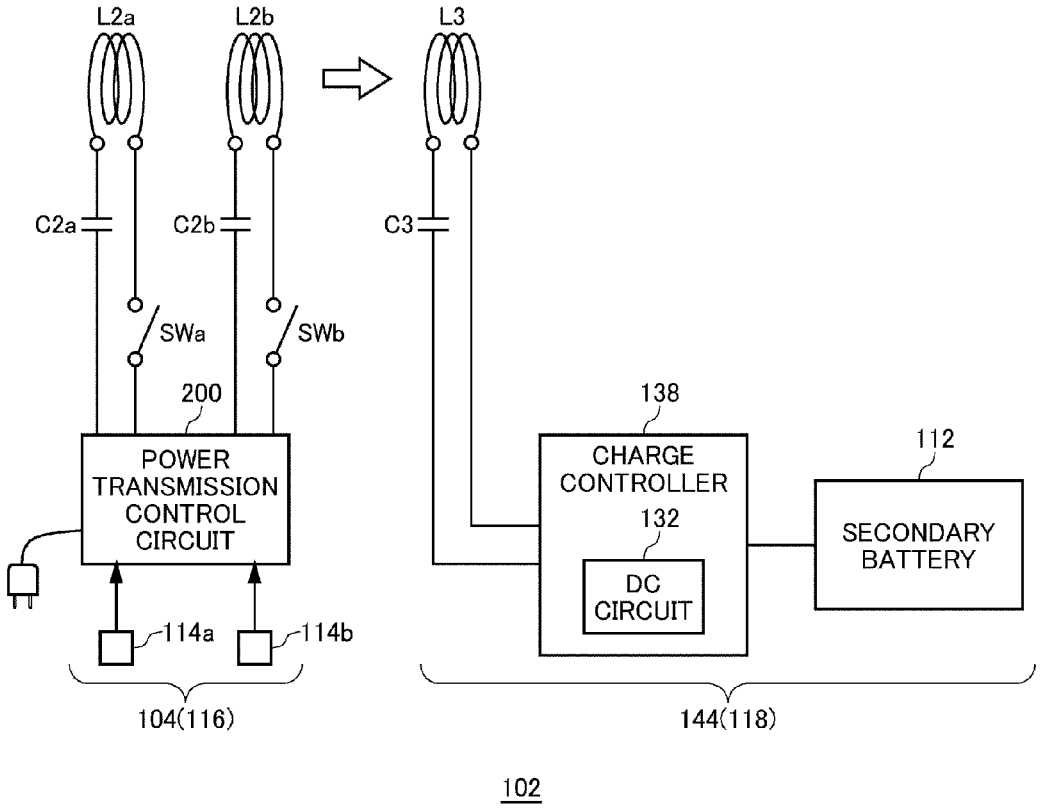
FIG. 8 is a system configuration view of the wireless headphone system according to the second embodiment.

FIG. 8 is a system configuration view of the wireless headphone system 102 according to the second embodiment. The headphone stand 104 (wireless power feeder 116) includes the feeding coils L2*a* and L2*b*, capacitors C2*a* and C2*b*, and the power transmission control circuit 200. The power transmission control circuit 200 performs ON/OFF control of switches SWa and SWb to selectively supply AC power to the feeding coils L2*a* and L2*b*. When the receiving module 114*a* has received the infrared ray signal, the switch SWa is turned ON and switch SWb is turned OFF, and the power feeding is conducted from the feeding coil L2*a*. On the other hand, when the receiving module 114*b* has received the infrared ray signal, the switch SWa is turned OFF and switch SWb is turned ON, and the power feeding is conducted from the feeding coil L2*b*.

The wireless headphone system 102 based on a wireless power feeding technology has been described based on the above embodiments. In the headphone 144, the feeding coil L2 and secondary battery 112 are separately provided in the two ear cups 150, respectively, allowing the left and right weight balance to be kept and suppressing the eddy current from occurring in the secondary battery 112. Further, infrared communication using the infrared ray LED 122 and receiving module 114 allows the battery charging to be automatically executed simply by setting the headphone 144 in the headphone stand 104.

In the wireless headphone system 102 according to the second embodiment, the feeding coil L2 is installed in an inclined manner so that the feeding coil L2 and receiving coil L3 become substantially parallel to each other in a state where the headphone 144 is set in the headphone stand 104, easily enhancing the power transmission efficiency.

The present invention has been described based on the above embodiments. It should be understood by those skilled in the art that the above embodiments are merely exemplary of the invention, various modifications and changes may be made within the scope of the claims of the present invention, and all such variations may be included within the scope of the claims of the present invention. Thus, the descriptions and drawings in this specification should be considered as not restrictive but illustrative.

The "AC power" used in the wireless power transmission system 100 may be transmitted not only as an energy but also as a signal. Even in the case where an analog signal or digital signal is fed by wireless, the wireless power feeding method of the present invention may be used.

Although the "magnetic field resonance type" that utilizes a magnetic field resonance phenomenon has been described in the present embodiments, the magnetic field resonance is not essential in the present invention. For example, the present embodiment can be applied to the above-described type A (for short distance) that utilizes the electromagnetic induction, wherein the feeding coil and receiving coil are electromagnetically coupled (inductively coupled) as in the "magnetic field resonance type". Further, the present embodiments can be applied to an electric field resonance system (see Jpn. Pat. Appln. Laid-Open Publication No. 2012-044857).

The audio receiving unit 136 and audio reproducing unit 152 may be incorporated in the ear cup 150*a* (first ear cup); however, a strong magnetic field generated around the feeding coil L2 and receiving coil L3 may cause the eddy current, so that audio receiving unit 136 and audio reproducing unit 152 are preferably incorporated in the ear cup 150*b* (second ear cup).

Although the headphone used in the present embodiments has the head band 106, the present invention may be applied to a headphone having a neck band. The head band or the neck band is not essential in the present invention. That is, the present invention may be applied to any audio reproducing device having the two ear cups 150.

The wireless power feeder 116 need not always be a resonance circuit. For example, a configuration may be employed in which the capacitor C2 is omitted, and AC current of the resonance frequency fr1 is supplied from a power feeding source VG to the feeding coil L2 (see U.S. Patent Application Publication No. 2012/0146425).

What is claimed is:

1. A headphone comprising:

first and second ear cups, the first ear cup including a receiving coil wirelessly receiving AC power from an external feeding coil and a capacitor connected to the receiving coil to form therewith a resonance circuit, the second ear cup including a secondary battery charged with the AC power received by the receiving coil, wherein the first ear cup includes a magnet and a yoke bonded to the magnet, and the receiving coil is positioned closer to the ear pad side than the yoke.

2. The headphone according to claim 1, wherein the second ear cup further includes a DC circuit converting the AC power into DC power.

3. The headphone according to claim 1, further comprising a transmitter transmitting a predetermined signal by wireless.

4. A headphone stand comprising:

a hanging portion for setting a headphone;

first and second feeding coils; and a power transmission control circuit supplying AC power to the first and second feeding coils to make the first and second feeding coils wirelessly supply the AC power to a receiving coil incorporated in the headphone, at least one of the first and second feeding coils facing the receiving coil in a state where the headphone is set in the hanging portion, wherein a transmitter wirelessly transmitting a predetermined signal and the receiving coil are incorporated in one of the two ear cups of the headphone, the headphone stand further includes first and second receivers which are provided corresponding to the first and second feeding coils, respectively, and receive the signal transmitted from the transmitter; and the power transmission control circuit supplies the AC power to the feeding coil corresponding to the receiver that has received the signal.

5. The headphone stand according to claim 4, wherein the receiving coil is incorporated in at least one of two ear cups of the headphone, and the first and second feeding coils are installed inclined at different angles which correspond respectively to installation angles of the two ear cups.

* * * * *